US011431131B2

(12) United States Patent
Lv et al.

(10) Patent No.: US 11,431,131 B2
(45) **Date of Patent: *Aug. 30, 2022**

(54) ELECTRICAL CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Lai-Hang Lv, Kunshan (CN); De-Jin Chen, Kunshan (CN); Xian-Wei Feng, Kunshan (CN); Xian-Liang Zhang, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 17/146,408

(22) Filed: Jan. 11, 2021

(65) Prior Publication Data

US 2021/0367381 A1 Nov. 25, 2021

(30) Foreign Application Priority Data

May 23, 2020 (CN) ..... 202010444677.X
May 23, 2020 (CN) ..... 202020887000.9

(51) Int. Cl.
*H01R 13/6582* (2011.01)
*H01R 13/627* (2006.01)
(Continued)

(52) U.S. Cl.
CPC ..... *H01R 13/6582* (2013.01); *H01R 13/502* (2013.01); *H01R 13/629* (2013.01); *H01R 13/6272* (2013.01); *H01R 13/6585* (2013.01)

(58) Field of Classification Search
CPC .. H01R 13/6581–6597; H01R 13/6272; H01R 13/502; H01R 13/629
(Continued)

(56) References Cited

U.S. PATENT DOCUMENTS 10,601,181 B2 * 3/2020 Lu ..... H01R 13/6272
2004/0058572 A1 3/2004 Amphenol
(Continued)

FOREIGN PATENT DOCUMENTS

CN 106785613 A 5/2017
CN 208608459 U 3/2019

*Primary Examiner* — Gary F Paumen
(74) *Attorney, Agent, or Firm* — Ming Chieh Chang; Wei Te Chung

(57) ABSTRACT

A receptacle connector for mating with a plug connector having a mating tongue and a latch thereof, includes an insulative housing defining a mating slot extending along a longitudinal direction to receive the mating tongue of the plug connector, and an outer metallic shield defining an upper space to receive the latch of the plug connector, and a lower space communicatively below the upper space to receive the housing. A plurality of contacts are disposed in the housing to mechanically and electrically connect to the mating tongue. An inner metallic shield is attached upon the upper wall of the housing to separate the upper space and the lower space from each other in a vertical direction.

20 Claims, 20 Drawing Sheets

(51) Int. Cl.
*H01R 13/502* (2006.01)
*H01R 13/6585* (2011.01)
*H01R 13/629* (2006.01)

(58) Field of Classification Search
USPC ..... 439/607.55, 607.56
See application file for complete search history.

(56) References Cited

U.S. PATENT DOCUMENTS

| | | | | |
|---|---|---|---|---|
| 2013/0040492 | A1* | 2/2013 | Wu | H01R 13/5808 439/607.55 |
| 2014/0199874 | A1 | 7/2014 | Molex | |
| 2019/0173232 | A1 | 6/2019 | Amphenol | |
| 2021/0218197 | A1* | 7/2021 | Lv | H01R 13/506 |

* cited by examiner

ELECTRICAL CONNECTOR ASSEMBLY

BACKGROUND OF THE INVENTION

1. Field of the Invention

The present invention relates to an electrical contact assembly including mated receptacle connector and plug connector with the corresponding latching structure, and particularly to the receptacle having a fully intimately surrounding metallic shield for both mechanical reinforcement consideration and electrical shielding consideration. This invention is related to the copending application having the same inventors, the same applicant, the same title and the same filing date.

2. Description of Related Arts

China Patent No. CN208045830U discloses a receptacle connector including an insulative housing with a receiving slot therein and a metallic shield enclosing the housing wherein one long side plate of the shield is spaced from the corresponding long side wall with a space therebetween in a transverse direction to allow a latch of the plug connector to be received within for latching. In other words, only three sides of the housing are intimately covered by and retained to the corresponding three side plates of the shield while the long side of the housing which communicatively faces toward the space is essentially exposed without proper protection either from the viewpoint of the electrical shielding effect or the mechanical reinforcing effect disadvantageously.

Therefore, it is desired to provide a receptacle connector with a fully intimately surrounding metallic shield while still maintain the corresponding latching mechanism for engagement with the latch of the plug connector.

SUMMARY OF THE INVENTION

A receptacle connector for mating with a plug connector having a mating tongue and a latch thereof, includes an insulative housing defining a mating slot extending along a longitudinal direction to receive the mating tongue of the plug connector along a mating direction, i.e., the front-to-back direction perpendicular to the longitudinal direction, and an outer metallic shield defining a lower space to receive the housing and an upper space communicatively located above the lower space in the vertical direction to receive the latch of the plug connector. A plurality of contacts are disposed in the housing to mechanically and electrically connect to the mating tongue. An inner metallic shield is attached upon an upper face of the housing to separate the upper space and the lower space from each other in a vertical direction wherein the inner metallic shield may optionally form a cutout to compliantly accommodate the corresponding latch mechanism therein, and may optionally be equipped with an insulative tape on an inner surface to avoid any improper electrical connection risk between the inner metallic shield and the outwardly deflected contacts when the mating tongue of the plug connector is received and mated within the mating slot.

Other advantages and novel features of the invention will become more apparent from the following detailed description of the present embodiment when taken in conjunction with the accompanying drawings.

DETAILED DESCRIPTION OF THE PREFERRED EMBODIMENT

An electrical connector assembly 500 includes a receptacle connector 100 and the plug connector 200 adapted to be connected with each other. In this embodiment, the electrical connector assembly belongs to MCIO (Mini Cool Edge IO). In this embodiment, the mating direction is the front-to-back direction, the mating direction.

Figure 1:
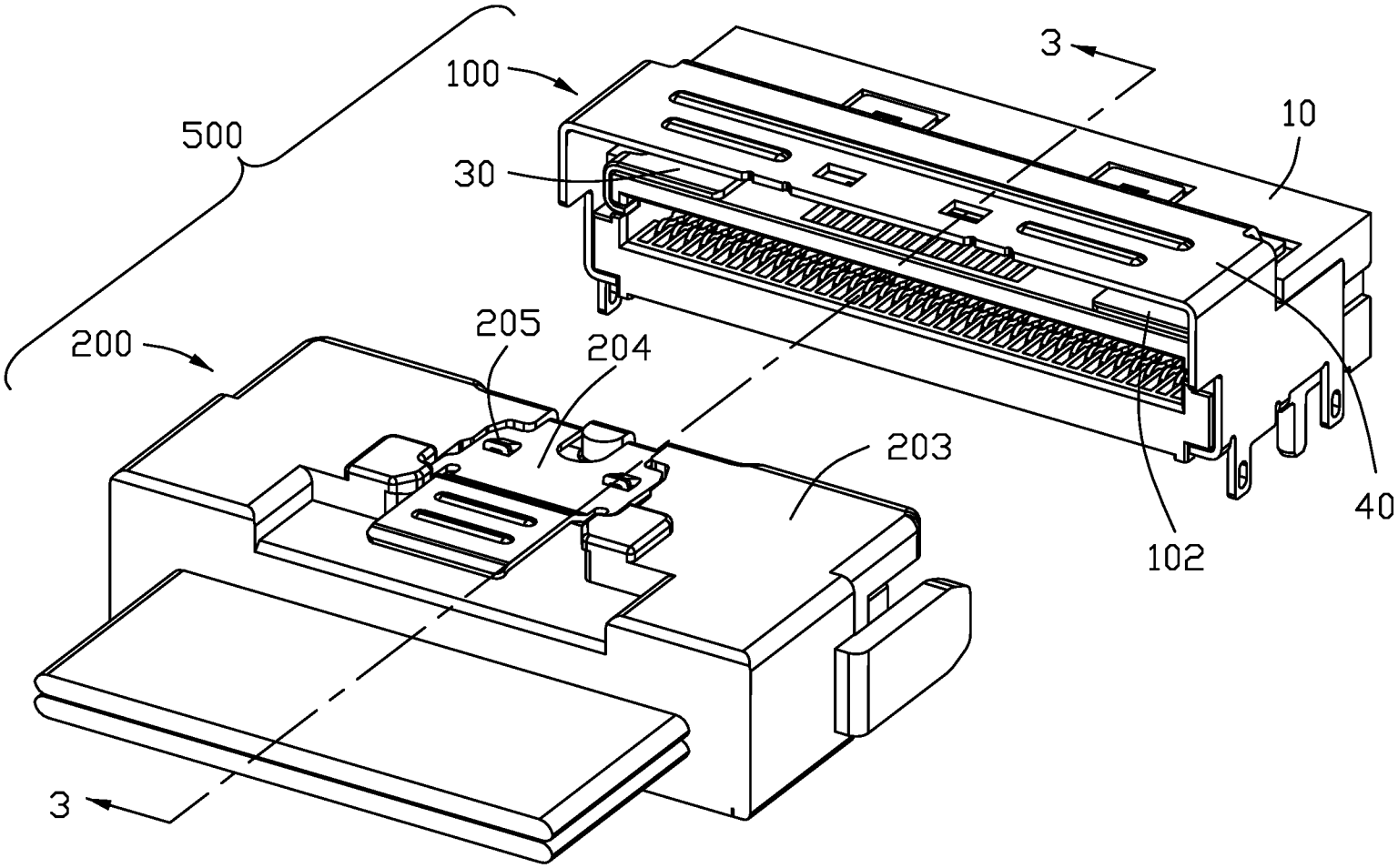
FIG. 1 is a perspective view of an electrical connector assembly including the receptacle connector and the plug connector adapted to be mated with each other in a separated manner according to the invention.
Figure 2:
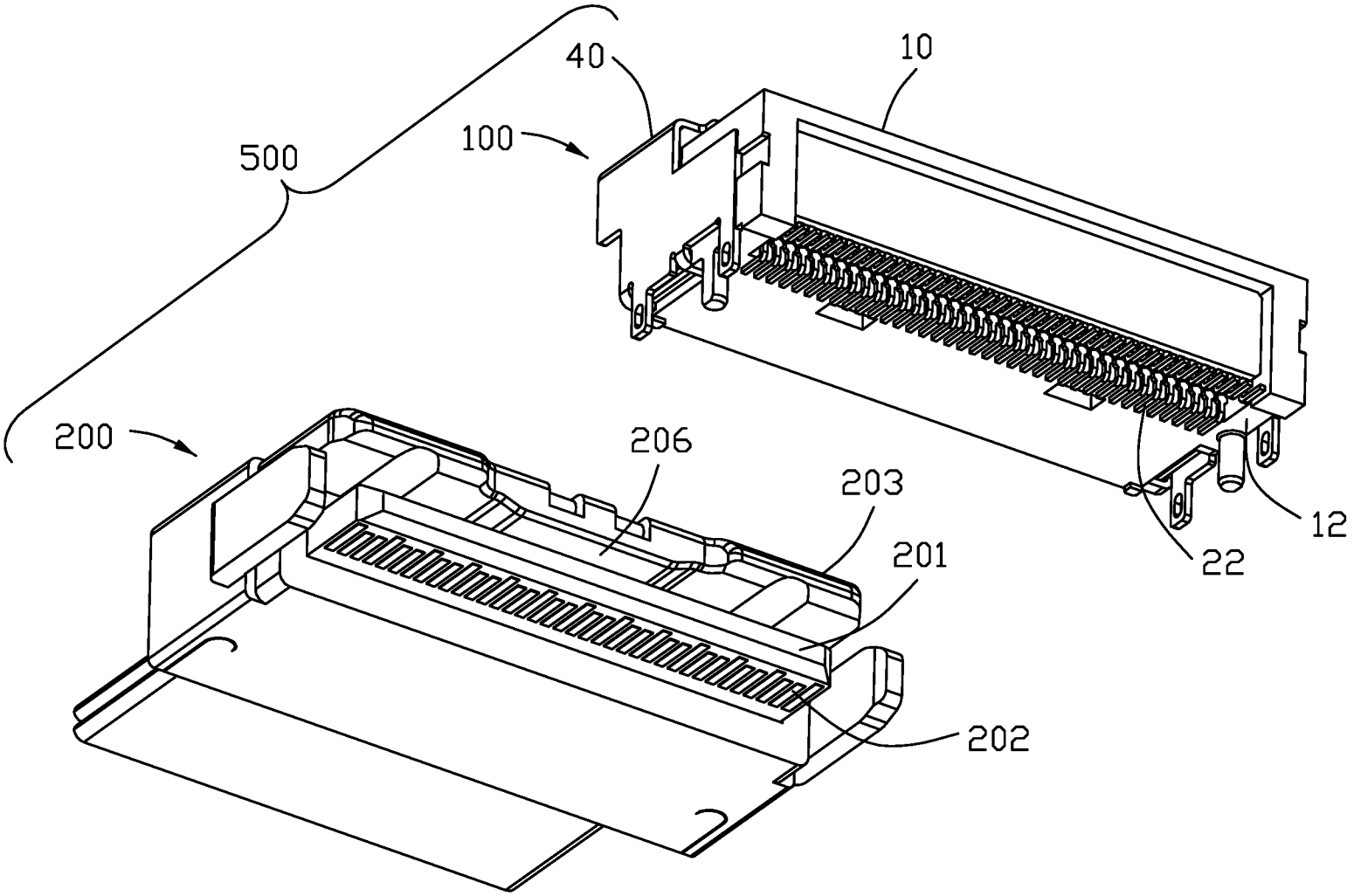
FIG. 2 is another perspective view of the electrical connector assembly of FIG. 1.
Figure 3:
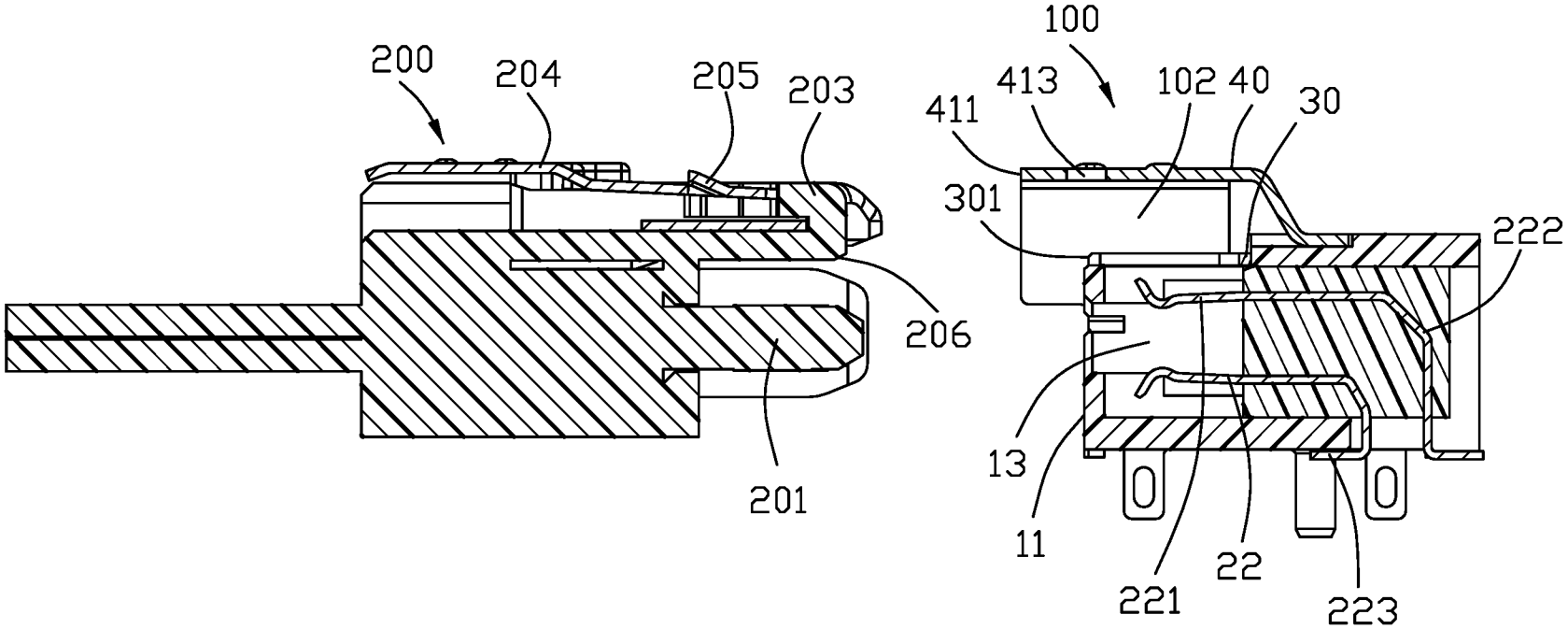
FIG. 3 is a cross-sectional view of the electrical connector assembly of FIG. 1.
Figure 4:
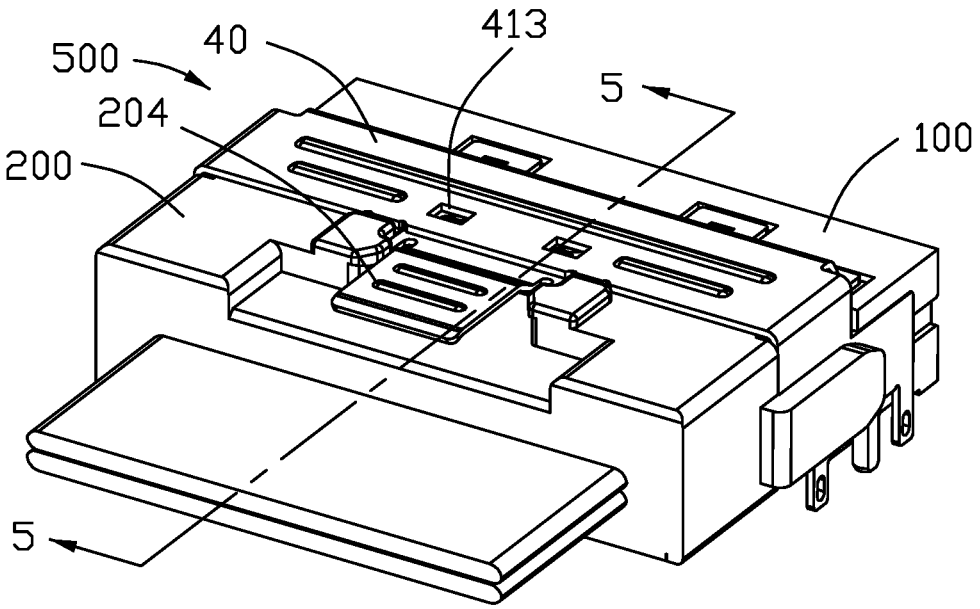
FIG. 4 is a perspective view of the electrical connector assembly of FIG. 1 wherein the plug connector and the receptacle connector are mated with each other.
Figure 5:
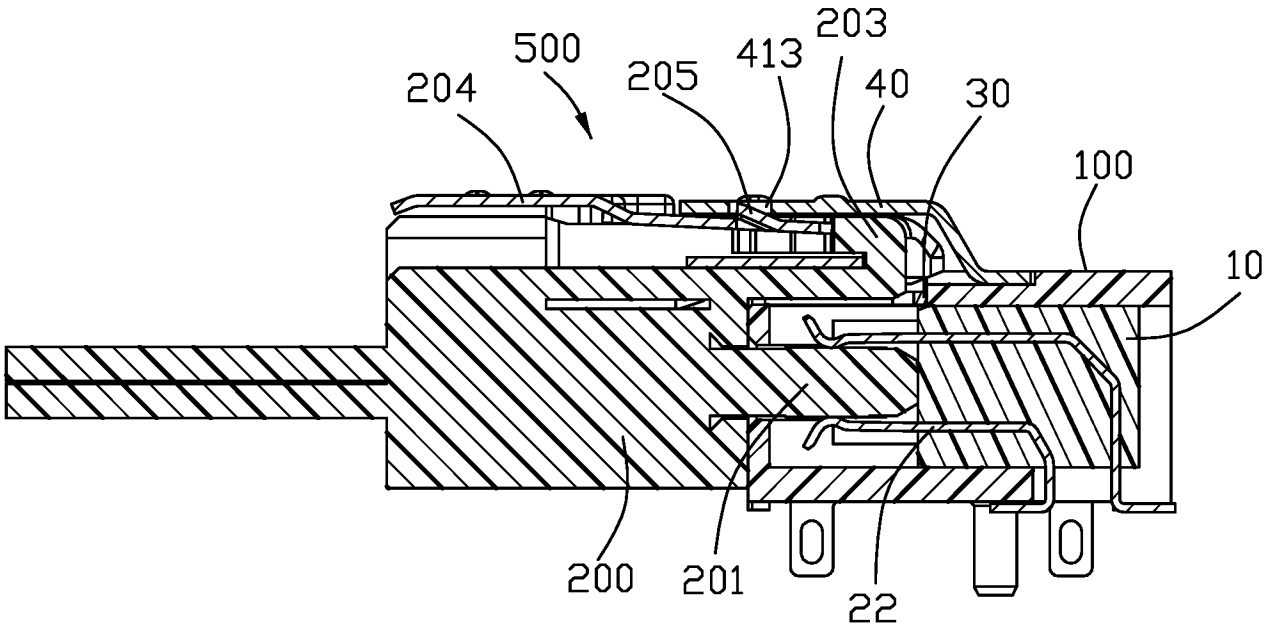
FIG. 5 is across-sectional view of the electrical connector assembly of FIG. 4.

As shown in FIGS. 1-5, the plug connector 200 includes a mating tongue 201 with a plurality of plug contacts 202 thereon, and an extending plate 203 parallel to the mating tongue 201 with a deflectable latch 204 thereon. The extending plate 203 extends forwardly beyond the mating tongue 201 in the vertical direction.

Figure 6:
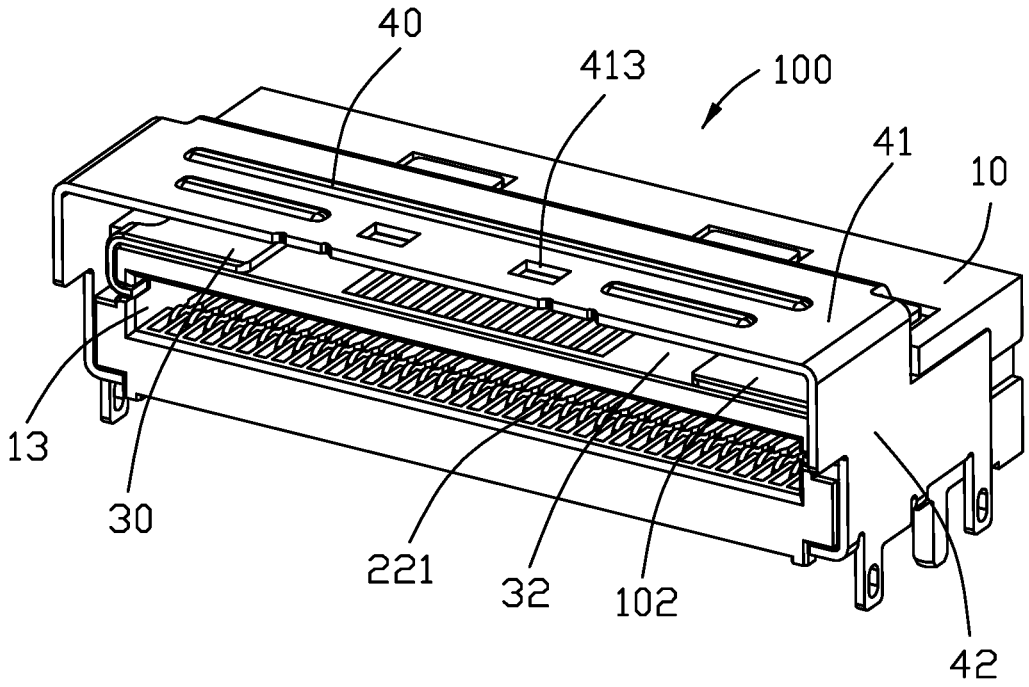
FIG. 6 is a perspective view of the receptacle connector of the electrical connector assembly of FIG. 1.
Figure 7:
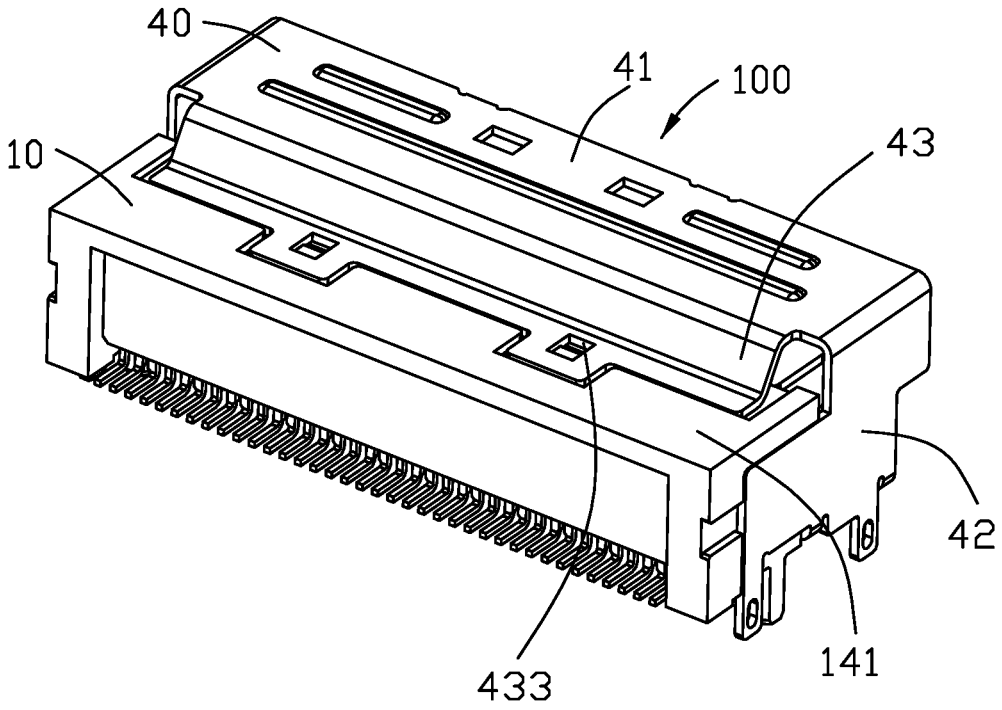
FIG. 7 is another perspective view of the receptacle connector of the electrical connector assembly of FIG. 6.
Figure 8:
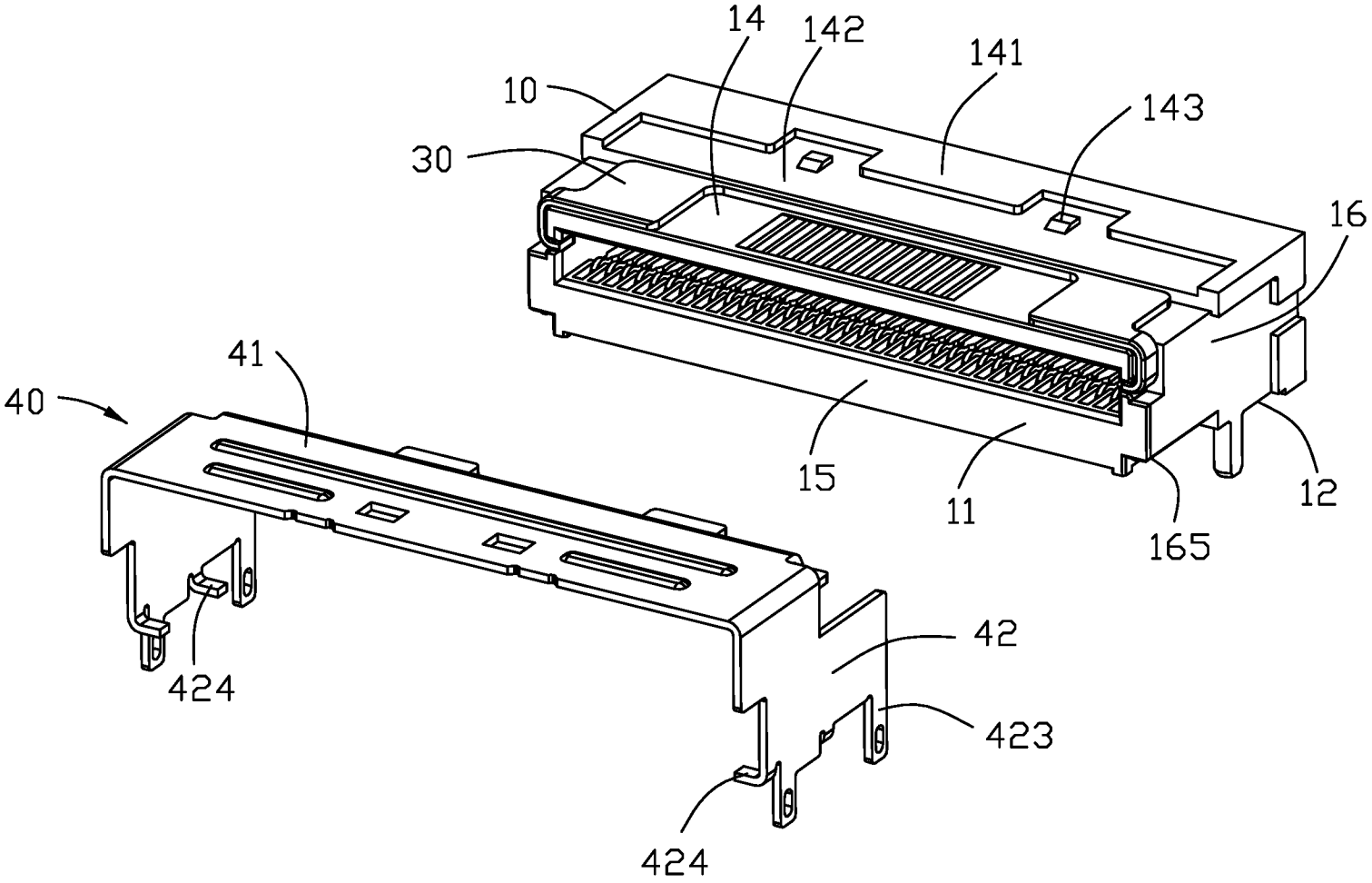
FIG. 8 is an exploded perspective view of the receptacle connector of the electrical connector assembly of FIG. 7.
Figure 9:
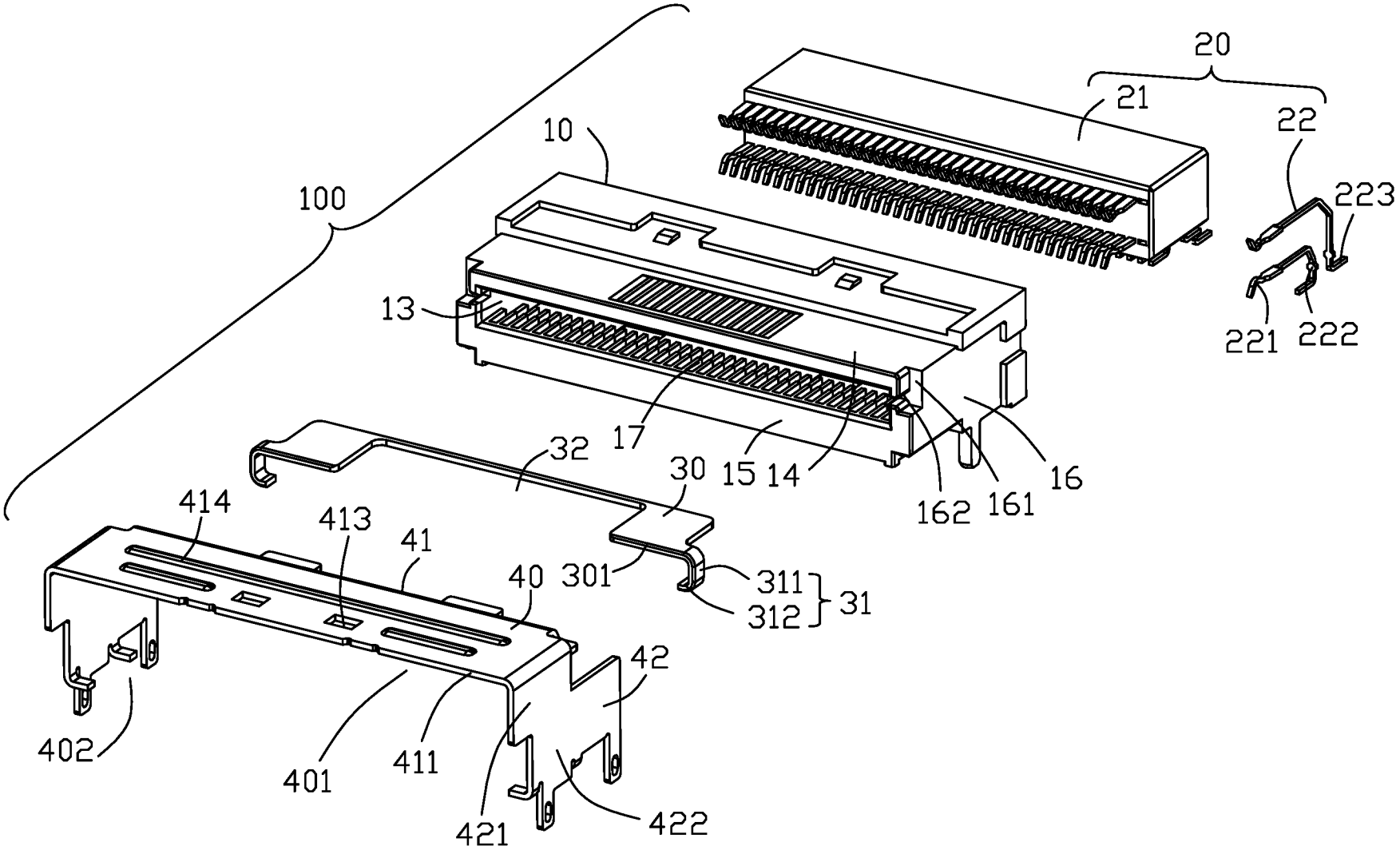
FIG. 9 is a further exploded perspective view of the receptacle connector of the electrical connector assembly of FIG. 8.
Figure 10:
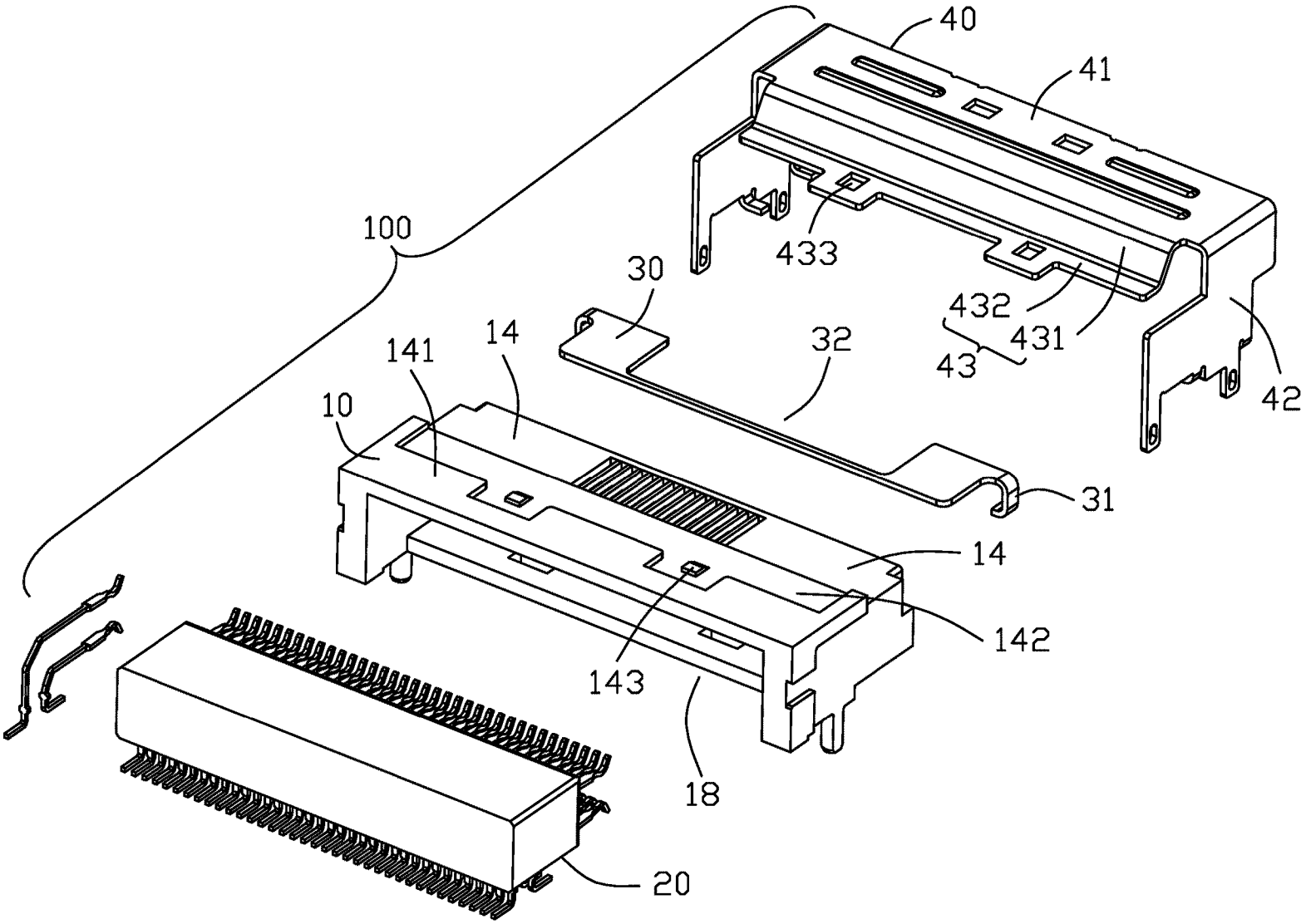
FIG. 10 is another exploded perspective view of the receptacle connector of the electrical connector assembly of FIG. 8.

As further shown in FIG. 6-10, the receptacle connector 100 includes an insulative housing 10 enclosing a contact module 20, an outer metallic shield 40 surrounding the housing 10, and an inner metallic shield 30 attached upon one side of the housing 10.

The housing 10 includes a mating/front face 11 and a mounting/bottom face 12 perpendicular to each other with a mating slot 13 extending along the longitudinal direction and communicatively located behind the mating face 11 in the front-to-back direction. A upper wall 14 and the bottom wall 15 are respectively located by two sides of the mating slot 13 in the vertical direction. Each of the upper wall 14 and the bottom wall 15 extends in the longitudinal direction. A pair of side walls 16, are connected between opposite sides of the upper wall 14 and the lower wall 15 Each of the side walls 16 extends in the vertical direction. Each of the upper wall 14 and the lower wall 15 forms a plurality of passageways 17 to communicate with the mating slot 13 in the vertical direction.

The housing 10 forms a mounting cavity 18 above the mounting face 12 so as to have the contact module 20 forwardly assembled thereinto. The contact module 20 includes a plurality of contacts 22 integrally formed within an insulator 21 via insert-molding. Each contact 22 includes an upper contacting section 221 extending into the mating slot 13, a lower mounting section 223 around the mounting face 12, and a middle retaining section 222 therebetween.

The outer metallic shield 40 is rearwardly assembled upon the housing 10 and includes a top plate 41 extending in the front-to-back direction and spaced from the upper wall 14 in the vertical direction, a pair of side plates 42 extending downwardly from two opposite lateral side edges of the top plate 41 to cooperate with the top plate 41 to form a receiving space 401. The top plate 41 forms a pair of locking holes 413 for engagement with the locking lugs 205 of the latch 204 of the plug connector 200. A pair of ribs 414 are formed on the top plate 41 for reinforcement consideration. The top plate 41 is spaced from the upper wall 14, and an inner metallic shield 30 is attached upon the upper wall 14. The inner metallic shield 30 is spaced from the top plate 41 with an insertion space 102 therebetween in the vertical direction for receiving the extending plate 203 of the plug 200. The outer metallic shield 40 forms a U-shaped structure in an elevational view with a bottom opening 402 to have the receiving space 401 downwardly communicate with an exterior. Each side wall 16 forms a cutout 165, and the corresponding side plate 42 includes engagement tabs 424 received in the cutout 165 for preventing upward movement of the outer shield 40 from the housing 10. Each side plate 42 further includes a pair of legs 423 for mounting to the printed circuit board.

The top plate 41 extends forwardly beyond mating face 11 and is longer than the inner metallic shield 30 in the front-to-back direction. The front face 11 is aligned within the locking hole 413 in the vertical direction. The side plate 42 forms a Z-shaped configuration and includes an upper portion 421 in alignment with the insertion space 102 in the longitudinal direction, and a lower portion 422 in alignment with the housing 10 in the longitudinal direction. The front edge 301 of the inner metallic shield 30 is flush with or located behind the mating face 11. The front edge of the upper portion 421 is located in front of that of the second portion 422 and but being flush with the front end of the side plate 42.

In this embodiment, both the inner metallic shield 30 and the outer metallic shield 40 are discrete from each other and assembled rearwardly to the housing 10. The inner metallic shield 30 includes a pair of hooks at two opposite ends in the longitudinal direction, and each hooks 33 includes a first section 311 and a second section 312, and the side wall 16 of the housing 10 forms a first portion 161 and the second portion 162 to receive the first section 311 and the second section 312. The inner metallic shield 30 includes a cutout 32 in alignment with the pair of looking holes 413.

The top wall 41 forms a step 141 to forwardly abut against the rear edge of the inner metallic shield 30. A recess 142 is located in front of the step 141 with a pair of blocks 143 therein. The top plate 41 includes a rearwardly extending blade 43, and the rearwardly extending blade 43 includes an oblique section 431 and a horizontal section 432 received in the recess 142 with the holes 433 receiving the corresponding blocks 143. Via engagement between the extending blade 43 and the housing 10, the outer metallic shield 40 is structurally reinforced. In this embodiment, an inner surface of the inner metallic shield 30 may be applied with an insulative tape for avoiding any improper electrical connection between the inner metallic shield 30 and the outwardly deflected contacts 22 when the plug connector 200 is mated with the receptacle connector 100.

As shown in FIGS. 1-5, when the plug connector 200 is mated with the receptacle connector 100, the extending plate 203 firstly enters the insertion space 102 and the mating tongue 201 successively enters the primary space 103. When the plug connector 200 and the receptacle connector 100 are fully mated with each other, the locking lug 205 of the latch 204 is engaged within the corresponding locking hole 413. The extending plate 203 further includes an inward/downward protrusion 206 opposite to the latch 204 to be snugly received within the cutout 32 of the inner metallic shield 30 so as to stabilize the mating between the plug connector 200 and the receptacle connector 100.

Compared with the traditional receptacle connector as shown in the aforementioned CN208045830U, in the instant invention the receptacle connector 100 is further equipped with an inner metallic shield 30 to divide the receiving space into the primary space (not labeled) for receiving the housing 10, and an insertion space 102 for receiving the extending plate 203 of the plug connector 200 wherein the cutout 32 of the inner metallic shield 30 receives the inward protrusion 206 of the plug connector 200. Notably, the inner metallic shield 30 and the outer metallic shield 40 are electrically connected with each other around the side wall 16 via the corresponding hook 31.

Figure 11:
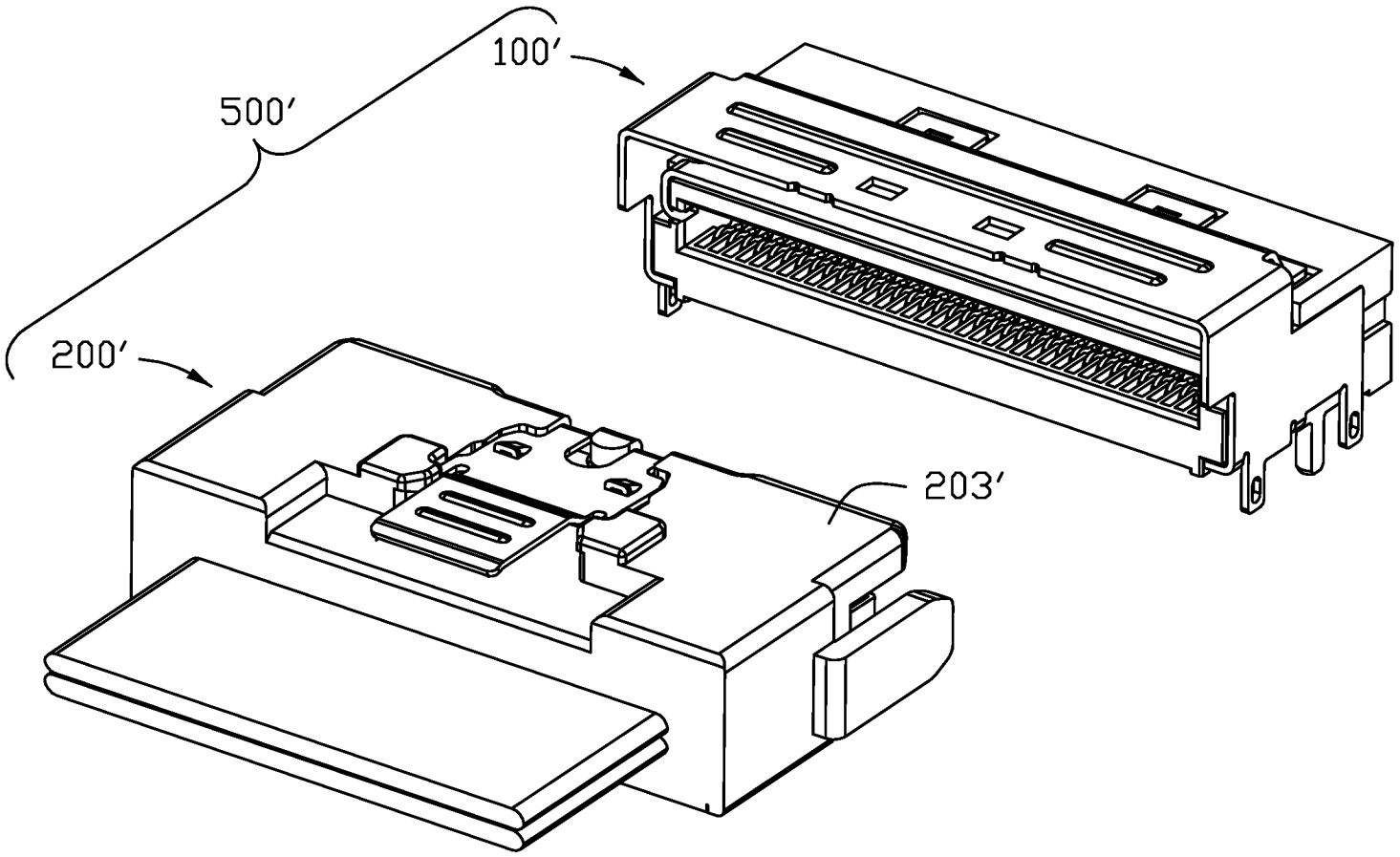
FIG. 11 is a perspective view of the electrical connector assembly according to another embodiment of the invention wherein the plug connector and the receptacle connector are separated from each other.
Figure 12:
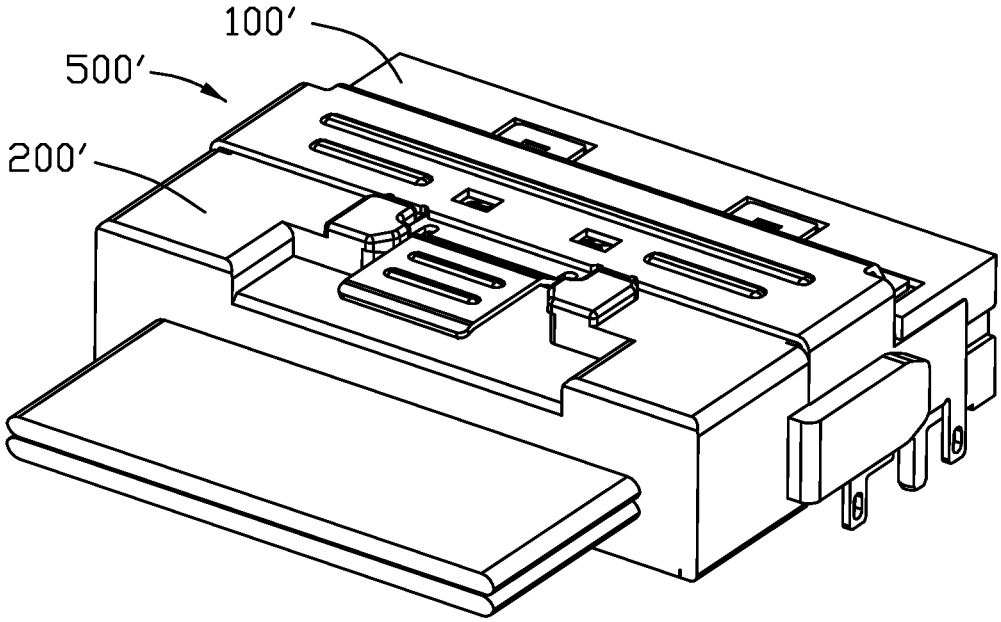
FIG. 12 is another perspective view of the electrical connector assembly of FIG. 11 wherein the plug connector and the receptacle connector are mated with each other.
Figure 13:
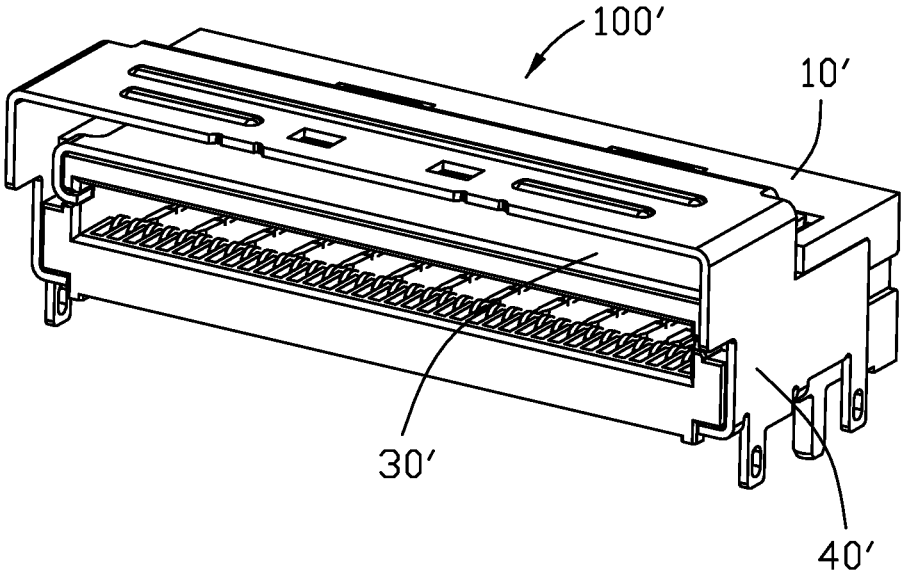
FIG. 13 is a perspective view of the receptacle connector of the electrical connector assembly of FIG. 11.
Figure 14:
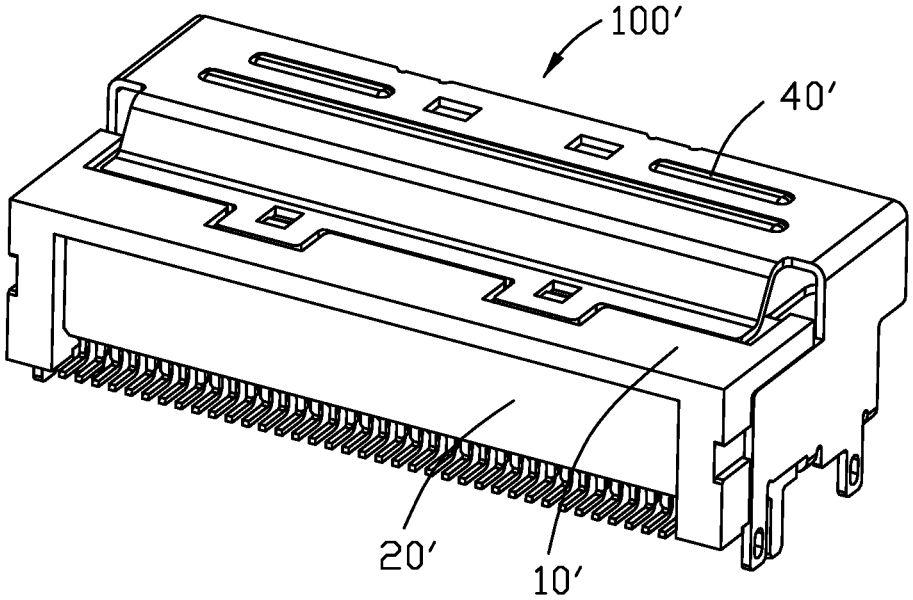
FIG. 14 is another perspective view of the receptacle connector of the electrical connector assembly of FIG. 13'
Figure 15:
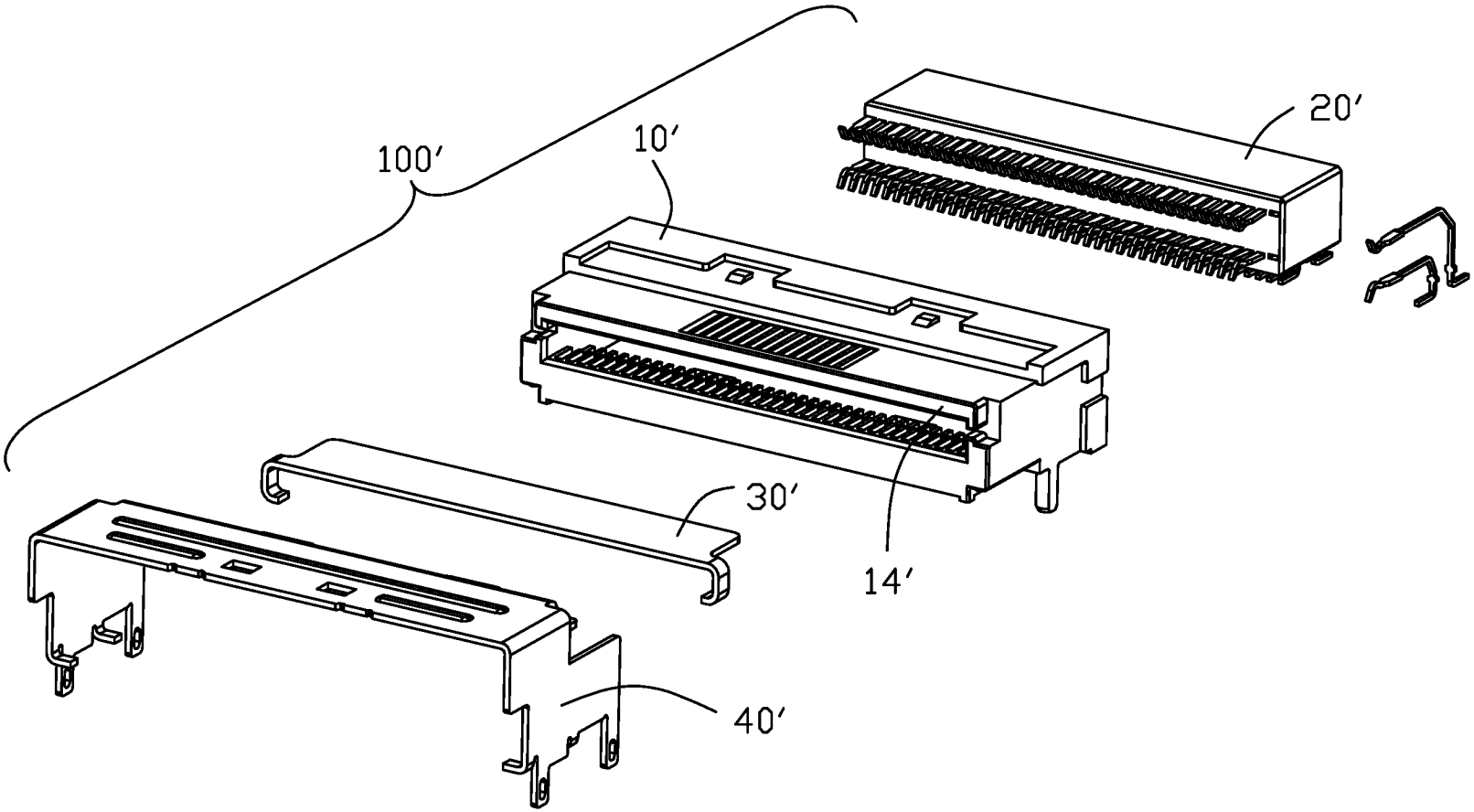
FIG. 15 is an exploded perspective view of the receptacle connector of the electrical connector assembly of FIG. 13.
Figure 16:
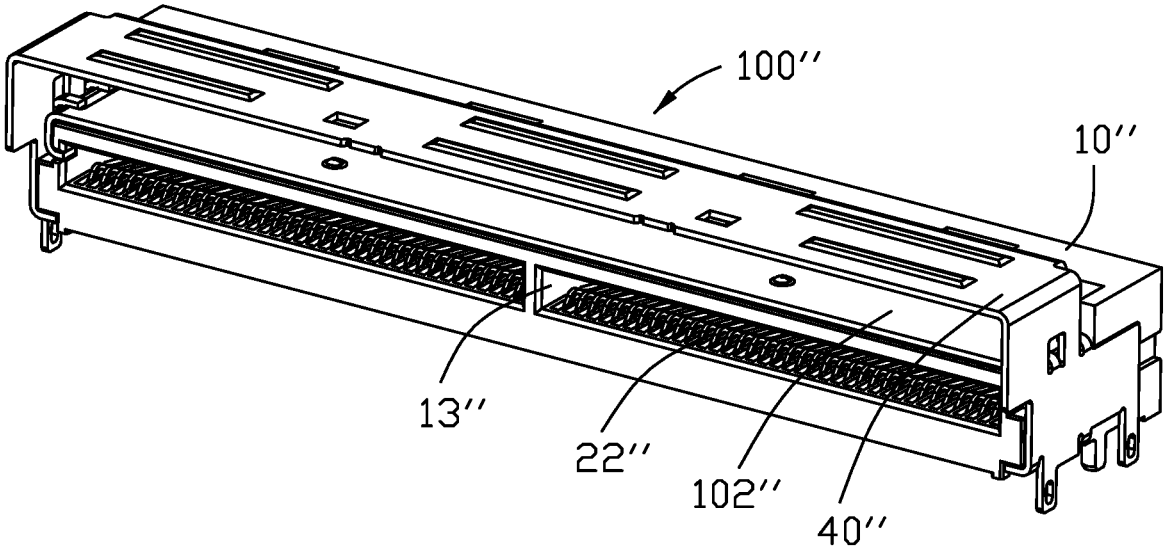
FIG. 16 is a perspective view of the receptacle connector of the electrical connector assembly according to a third embodiment of the invention.

Referring to FIGS. 11-15, in the second embodiment of the invention the electrical connector assembly 500 includes a receptacle connector 100' and the plug connector 200' belonging to the Low Profile SlimSAS connector assembly. Compared with the first embodiment shown in FIGS. 1-10, in the second embodiment shown in FIGS. 11-16 no recess structure is formed in the inner metallic shield 30'. Similarly, the extending plate 203' of the plug connector 200' forms no inward protrusion.

Figure 17:
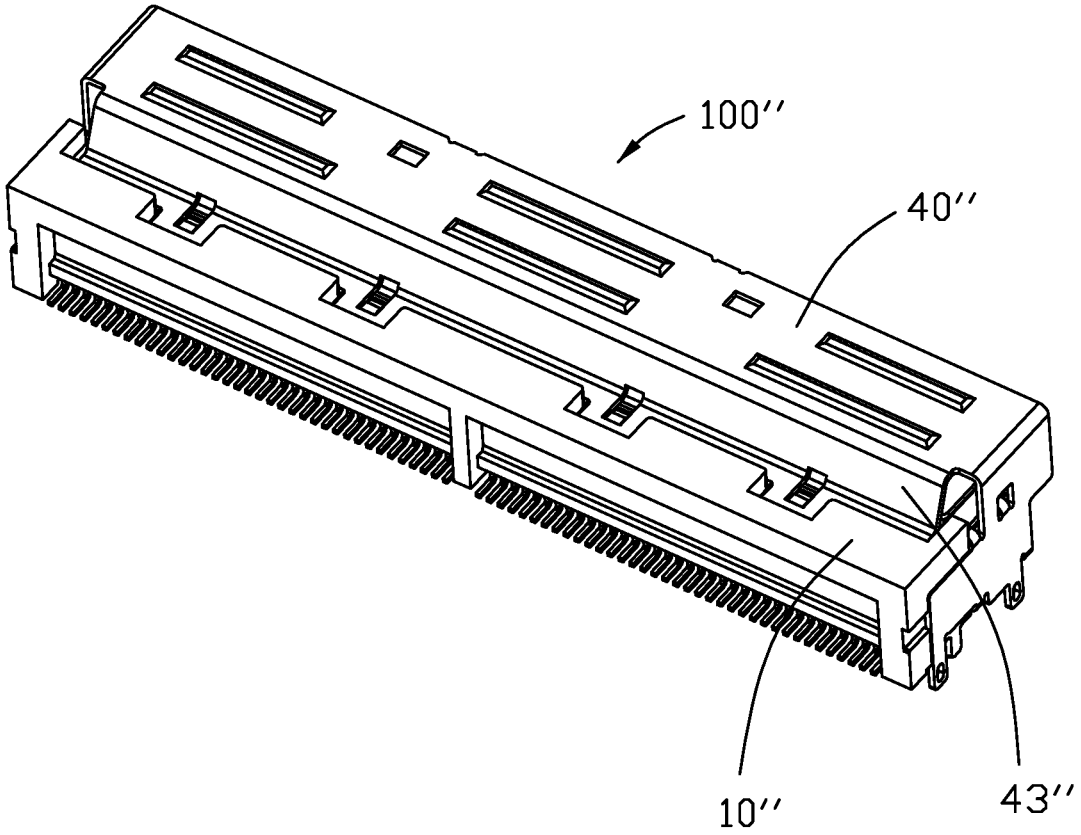
FIG. 17 is another perspective view of the receptacle connector of the electrical connector assembly of FIG. 16.
Figure 18:
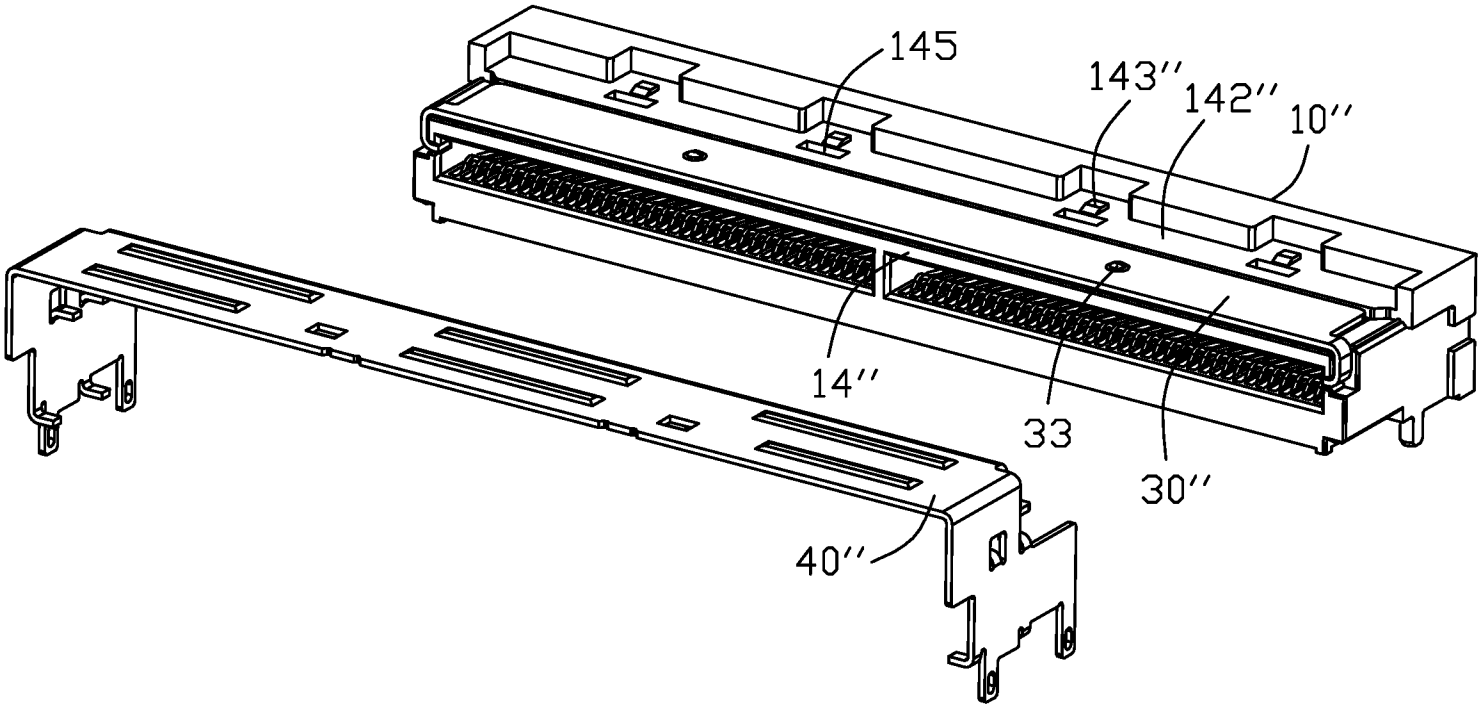
FIG. 18 is an exploded perspective view of the receptacle connector of the electrical connector assembly of FIG. 16.
Figure 19:
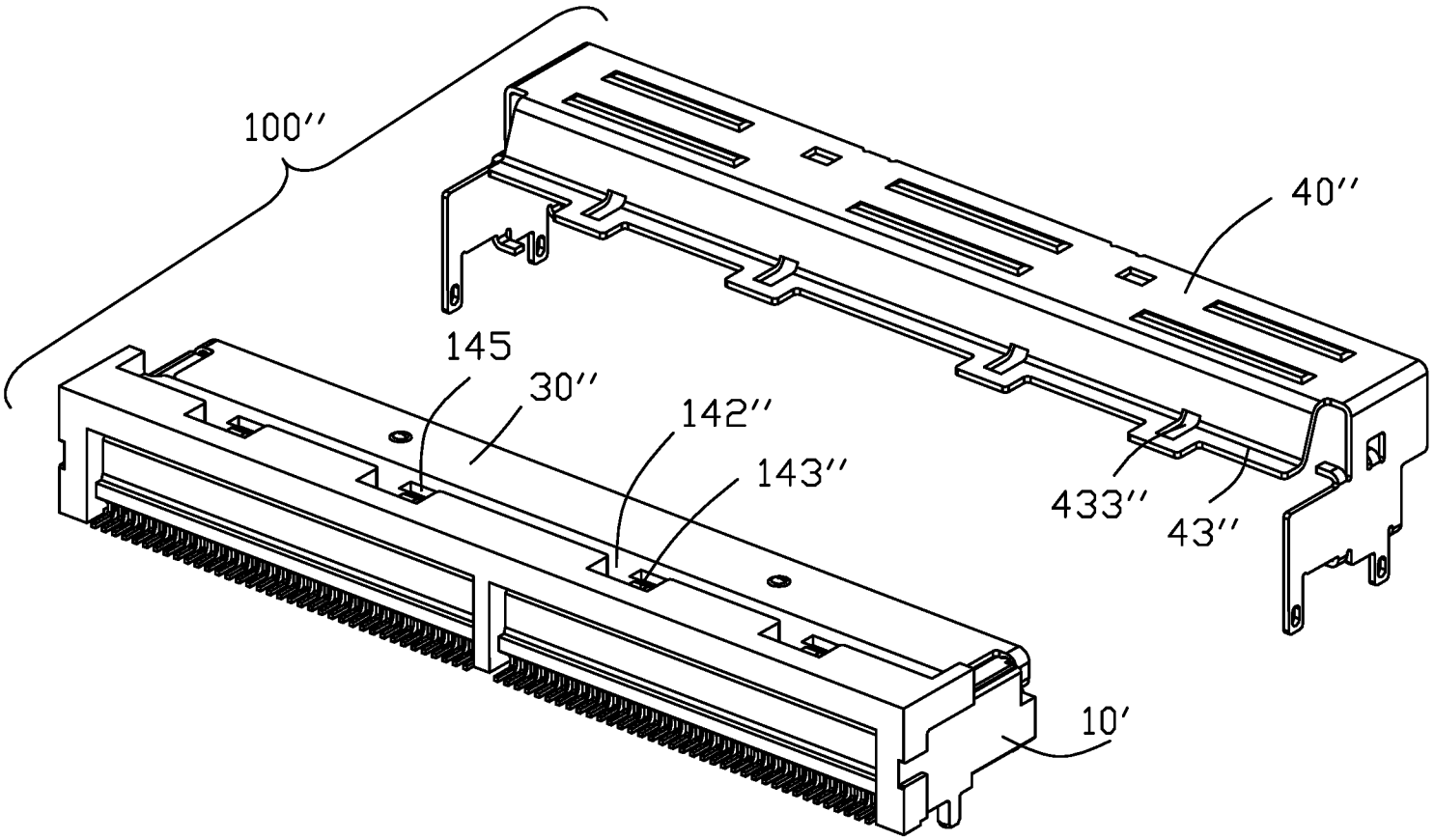
FIG. 19 is another exploded perspective view of the receptacle connector of the electrical connector assembly of FIG. 18.
Figure 20:
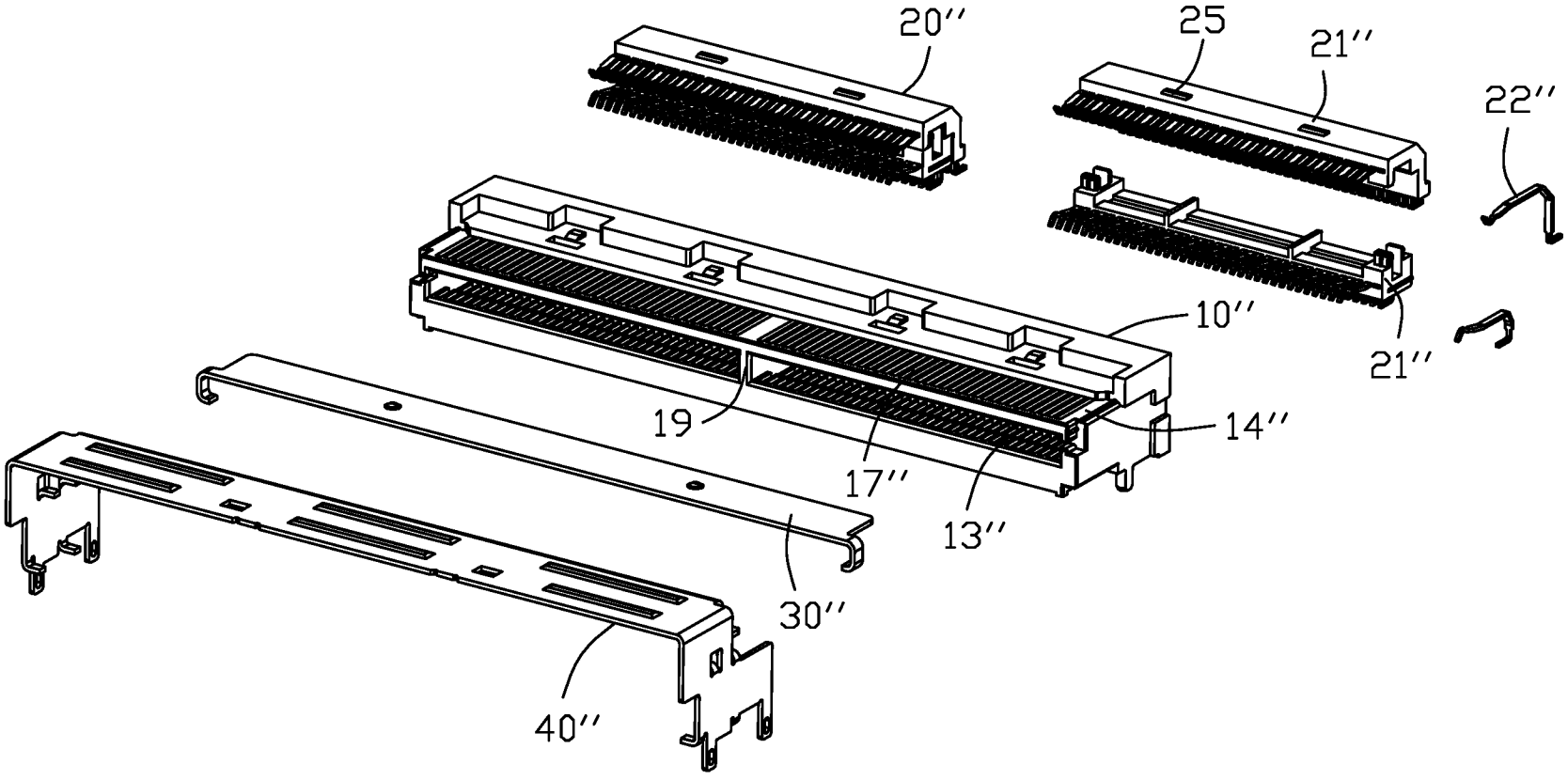
FIG. 20 is a further exploded perspective view of the receptacle connector of the electrical connector assembly of FIG. 18.

Referring to FIGS. 16-20, in the third embodiment of the invention the electrical connector assembly belongs to the Low Profile SlimSAS wherein the dimension of the housing 10" of the connector 100" is twice that of the housing 10' of the connector 100' with a partition 19 to separate the mating slot 13" into two parts. The contact module 20" includes two parts and each part includes a pair of insulators 21" integrally formed with the corresponding contacts 22". The extending blade 43" of the outer metallic shield 40" forms two pairs of holes 433" to receive two pairs of blocks 143" on the top wall 14". The top wall 14" further includes the holes 145 to receive the corresponding positioning blocks 25 on the insulator 21". The passageways 17 extend upwardly through the top wall 14". The inner metallic shield 30" forms a pair of dimples 33 extending into the insertion space 102 for increasing engagement with the extending plate of the plug connector during mating.

Compared with the conventional receptacle disclosed in the aforementioned China Patent CN208045830U, the invention includes an additional inner metallic shield attached upon the exterior surface of the top wall for not only the electrical shielding consideration but also the mechanical reinforcing consideration during mating.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

a receptacle connector and a plug connector, the receptacle connector including:

an insulative housing with an upper wall and a lower wall spaced from each other in a parallel relation with a mating slot therebetween in a vertical direction, the mating slot extending in a longitudinal direction perpendicular to the vertical direction and forwardly exposed to an exterior in a front-to-back direction perpendicular to both the vertical direction and the longitudinal direction;

a plurality of passageways formed in each of the upper wall and the lower wall;

a plurality of contacts disposed in the corresponding passageways respectively, each of the contacts including a contacting section extending into the mating slot in the vertical direction;

an outer metallic shield enclosing the housing with an insertion space located above the housing and adapted for receiving the plug connector;

said outer metallic shield including a top plate and a pair of side plates downwardly extending from two opposite side edges of the top plate; and an inner metallic shield positioned upon an upper surface of the upper wall to directly upwardly face the insertion space opposite to the top plate in the vertical direction; wherein the top plate forms a pair of locking holes for locking the plug connector.

2. The electrical connector assembly as claimed in claim 1, wherein the inner metallic shield forms a cutout in alignment with the pair of locking holes in the vertical direction.

3. The electrical connector assembly as claimed in claim 2, wherein the top plate further includes a rearwardly extending blade downwardly abutting against the upper wall with corresponding holes receiving the positioning blocks on the upper wall.

4. The electrical connector assembly as claimed in claim 1, wherein the inner metallic shield includes two hooks at two opposite ends thereof in the longitudinal direction, and the housing includes a pair of side walls in the longitudinal direction to retain the corresponding hooks thereto respectively.

5. The electrical connector assembly as claimed in claim 4, wherein the outer metallic shield includes a pair of side plates at two opposite ends thereof in the longitudinal direction with corresponding engagement tabs thereon to retain to the side walls, respectively, and the engagement tabs are located below the corresponding hooks, respectively, in the vertical direction.

6. The electrical connector assembly as claimed in claim 5, wherein each side plate forms a pair of legs with the engagement tab therebetween to upwardly abut against a step of the housing for preventing upward movement of the outer metallic shield from the housing.

7. The electrical connector assembly as claimed in claim 1, wherein the inner metallic shield and the outer metallic shield are electrically connected with each other around opposite ends of the housing in the longitudinal direction.

8. The electrical connector assembly as claimed in claim 1, wherein the plug connector is adapted to be mated with the receptacle connector, and the plug connector includes a mating tongue adapted to be received within the mating slot during mating, and an extending plate equipped with a latch thereon and adapted to be received within the insertion space with locking lugs of the latch engaged within the corresponding locking holes during mating.

9. The electrical connector assembly as claimed in claim 8, wherein the extending plate of the plug connector further includes an inward protrusion adapted to be received within the cutout of the inner metallic shield during mating.

10. An electrical connector assembly comprising:

a receptacle connector and a plug connector adapted to be mated with each other in a front-to-back direction, the plug connector including a mating tongue and an extending plate spaced from each other in a vertical direction perpendicular to the front-to-back direction, the extending plate being equipped with a latch;

the receptacle connector including:

an insulative housing defining a mating slot extending along a longitudinal direction perpendicular to both the front-to-back direction and the vertical direction for receiving the mating tongue of the plug connector, an upper wall and a lower wall located by two sides of the mating slot in the vertical direction;

a plurality of contacts retained to the upper wall and the lower wall;

an outer metallic shield forming a receiving space;

an inner metallic shield located in the receiving space and dividing, in the vertical direction, the receiving space into an upper space adapted to receive the extending plate of the plug connector during mating, and a lower space receiving the housing; wherein the outer metallic shield forms a locking hole adapted to receive a corresponding locking lug of the latch of the plug connector.

11. The electrical connector assembly as claimed in claim 10, wherein the extending plate of the plug connector further includes a downward protrusion, and the inner metallic shield forms a cutout adapted to receive the downward protrusion therein during mating.

12. The electrical connector 10, wherein the locking hole is aligned with the cutout in the vertical direction.

13. The electrical connector assembly as claimed in claim 10, wherein the inner metallic shield forms a pair of hooks at two opposite ends in the longitudinal direction to secure to two opposite side walls of the housing of the receptacle connector.

14. The electrical connector assembly as claimed in claim 13, wherein the outer metallic shield forms a pair of engagement tabs at two opposite ends in the longitudinal direction to secure to the two opposite end walls of the housing of the receptacle connector.

15. The electrical connector assembly as claimed in claim 14, wherein the pair of hooks are located above the pair of engagement tabs in the vertical direction.

16. The electrical connector assembly as claimed in claim 12, wherein in the receptacle connector, the outer metallic shield forms a pair of mounting legs with an engagement tab therebetween to upwardly abut against a step of the housing for preventing upward movement of the outer metallic shield from the housing.

17. An electrical connector assembly comprising:

a receptacle connector and a plug connector, the receptacle connector including:

an insulative housing with an upper wall and a lower wall spaced from each other in a parallel relation with a mating slot therebetween in a vertical direction, the mating slot extending in a longitudinal direction perpendicular to the vertical direction and forwardly exposed to an exterior in a front-to-back direction perpendicular to both the vertical direction and the longitudinal direction;

a plurality of passageways formed in each of the upper wall and the lower wall;

a plurality of contacts disposed in the corresponding passageways respectively, each of the contacts including a contacting section extending into the mating slot in the vertical direction;

an outer metallic shield enclosing the housing with an insertion space located above the housing and adapted for receiving the plug connector;

said outer metallic shield including a top plate and a pair of side plates downwardly extending from two opposite side edges of the top plate; and an inner metallic shield positioned upon an upper surface of the upper wall to directly upwardly face the insertion space opposite to the top plate in the vertical direction; wherein the inner metallic shield forms a cutout adapted to receive an inward protrusion formed on a downward extending plate of the plug connector.

18. The electrical connector assembly as claimed in claim 17, wherein the top plate forms a locking hole in alignment with the cutout in the vertical direction.

19. The electrical connector assembly as claimed in claim 18, wherein the inner metallic shield includes two hooks at two opposite ends thereof in the longitudinal direction, and the housing includes a pair of side walls in the longitudinal direction to retain the corresponding hooks thereto respectively.

20. The electrical connector assembly as claimed in claim 19, wherein the outer metallic shield includes a pair of side plates at two opposite ends thereof in the longitudinal direction with corresponding engagement tabs thereon to retain to the side walls, respectively, and the engagement tabs are located below the corresponding hooks, respectively, in the vertical direction.

* * * * *